US009555521B2

(12) United States Patent
St. Gelais et al.

(10) Patent No.: US 9,555,521 B2
(45) Date of Patent: Jan. 31, 2017

(54) LUG NUT CAP REMOVER PLIERS

(76) Inventors: Dan St. Gelais, Tillsonburg (CA); Neil Rampersad, Tillsonburg (CA)

( * ) Notice: Subject to any disclaimer, the term of this patent is extended or adjusted under 35 U.S.C. 154(b) by 1 day.

(21) Appl. No.: 14/407,323

(22) PCT Filed: Jun. 26, 2012

(86) PCT No.: PCT/IB2012/053213

§ 371 (c)(1),
(2), (4) Date: Apr. 20, 2015

(87) PCT Pub. No.: WO2014/001839

PCT Pub. Date: Jan. 3, 2014

(65) Prior Publication Data

US 2015/0343610 A1 Dec. 3, 2015

(51) Int. Cl.

| | |
|---|---|
| ***B25B 7/02*** | (2006.01) |
| ***B25B 7/08*** | (2006.01) |
| ***B25B 27/00*** | (2006.01) |
| ***B25B 27/02*** | (2006.01) |

(52) U.S. Cl.

CPC . *B25B 7/02* (2013.01); *B25B 7/08* (2013.01); *B25B 27/0035* (2013.01); *B25B 27/02* (2013.01)

(58) Field of Classification Search

CPC ..... B25B 7/00; B25B 7/02; B25B 13/58; B25B 1/24; B25B 1/2405; B25B 1/2457; B25B 1/2478; B25B 27/0035; B25B 27/02; B25B 7/08

USPC ..... 81/418–426.5

See application file for complete search history.

(56) References Cited

U.S. PATENT DOCUMENTS

| | | | | | |
|---|---|---|---|---|---|
| 215,972 | A | * | 5/1879 | Pitts | A01K 15/003 119/806 |
| 217,251 | A | * | 7/1879 | Weaver | B25B 7/02 81/420 |
| 241,353 | A | * | 5/1881 | Green | B25B 7/02 81/332 |
| 455,694 | A | * | 7/1891 | Steltz | B25B 13/48 81/129 |
| 519,550 | A | * | 5/1894 | Riordan | B25B 7/22 30/186 |
| 768,161 | A | * | 8/1904 | Thompson | B25B 7/22 294/3 |
| 925,513 | A | * | 6/1909 | Ryan | B25B 13/16 81/174 |
| 1,617,703 | A | * | 2/1927 | Christianson | B25B 7/02 81/415 |

(Continued)

*Primary Examiner* — Hadi Shakeri

(74) *Attorney, Agent, or Firm* — Honigman Miller Schwartz and Cohn LLP

(57) ABSTRACT

A pliers tool for the removal of lug nut caps includes a pair of elongated handle portions, a pair of jaw portions, a pair of neck portions, a pair of V-shaped clamping plates, a pair of V-shaped channels, and a pair of V-shaped chamfered edges. The pair of handle portions are at one end of the pliers tool. The pair of jaw portions are at another end of the pliers tool. The pair of neck portions are between the handle portions and the jaw portions. A first clamping plate of the pair of V-shaped clamping plates is directly attached to a first jaw portion of the pair of jaw portions. A first channel of the pair of V-shaped channels is attached to an end of the first clamping plate. A first chamfered edge of the pair of chamfered edges is disposed on an end of the first channel.

9 Claims, 9 Drawing Sheets

(56) References Cited

U.S. PATENT DOCUMENTS

| | | | | | |
|---|---|---|---|---|---|
| 1,872,392 | A * | 8/1932 | Bishman | B25B 13/16 | 7/100 |
| 4,872,709 | A * | 10/1989 | Stack | B25B 7/02 | 285/39 |
| 5,655,806 | A * | 8/1997 | Halladay | B67B 7/02 | 294/118 |
| 5,887,492 | A * | 3/1999 | De Laney | B25B 7/00 | 81/13 |
| D426,440 | S * | 6/2000 | Torres | D8/52 | |
| 6,220,126 | B1 * | 4/2001 | Domenge | B25B 7/04 | 81/418 |
| 2008/0302218 | A1 * | 12/2008 | Kurtz | B25B 7/02 | 81/415 |
| 2012/0133163 | A1 * | 5/2012 | Kavanagh | B25B 7/00 | 294/118 |

* cited by examiner

LUG NUT CAP REMOVER PLIERS

TECHNICAL FIELD

This is a plier-type hand tool for the removal of lug nut caps.

BACKGROUND ART

Lug nut cap remover pliers are pliers that remove lug nut caps. The purpose of lug nut caps is to protect lug nuts and lug threads from environmental elements and adds a beautifully finished look to the wheel. Lug nut caps are fitted over lug nuts on the wheels of transport trucks, campers, RV's and many other vehicles. Lug nut cap remover pliers are generally used by automotive and truck mechanics for the removal of the lug nut caps.

DISCLOSURE OF INVENTION

Technical Problem

Presently there are pliers that remove lug nut caps, however they are not reliable in terms of operator's safety or effectiveness in removing lug nut caps each time. The presently available pliers can only grip on the flat sided surfaces of the lug nut cap, should the lug nut cap be dirty or oily the rubber molding on the presently available pliers' gripping surface may not grip securely. This requires many retries, to remove the lug nut cap, forcing the mechanic to squeeze the currently available pliers very tightly, should the currently available pliers slip off the lug nut cap, there is a high possibility the operator will pinch their hand or fingers. Due to the pressure applied to remove the lug nut caps using the currently available pliers this may cause the lug nut caps to collapse as well as cause cosmetic damage such as scratches and tarnish to the beauty of the lug nut caps.

SOLUTION TO PROBLEM

Technical Solution

The present invention resolves the safety and effectiveness by changing the design of the jaws on the presently available lug nut cap removal pliers. Added to the jaws of the presently available pliers are V-shaped channels with chamfered edges. The chamfered edges of the V shaped channels pry between the lug nut cap and the wheel rim, providing a secure grip, without slippage of the lug nut cap remover pliers, allowing for easy and safe removal of lug nut caps.

ADVANTAGEOUS EFFECTS OF INVENTION

Advantageous Effects

The present invention will not only save the mechanical operator's time but will also resolve safety issues, due to the newly added V shaped channels and the chamfered edges. The chamfered edges at the end of the V shaped channels pry between the lug nut cap and the wheel rim which provides a better grip, without slippage, and as a result saves time because just one usage of the tool can be used to perform the task and will not collapse, scratch or tarnish the beauty of the lug nut caps.

BRIEF DESCRIPTION OF DRAWINGS

Description of Drawings

Figure 1:
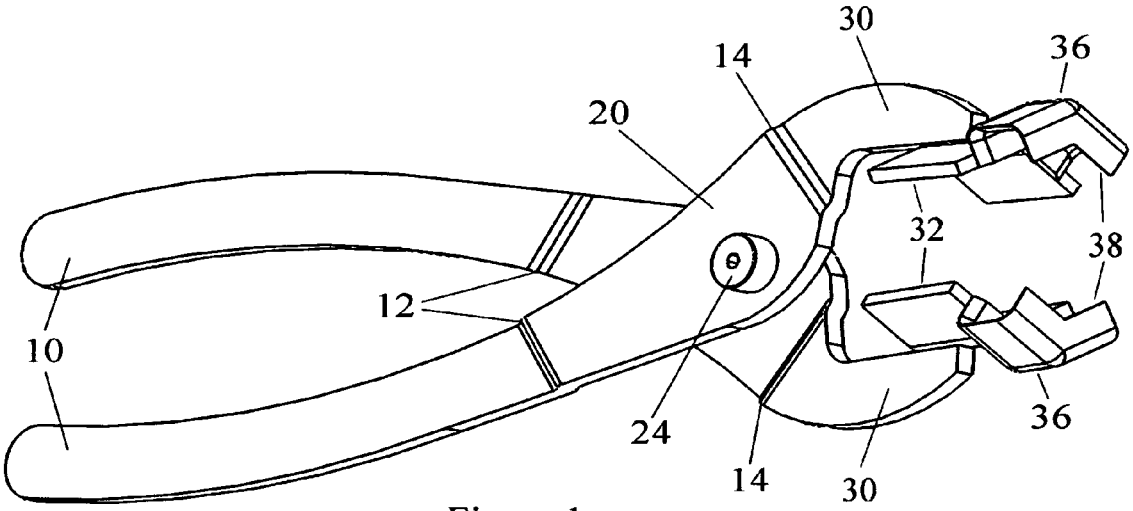

FIG. 1 is a perspective view of the pliers embodying the present invention with the jaw portion in an open position suitable for gripping a collared lug nut cap.

Figure 2:
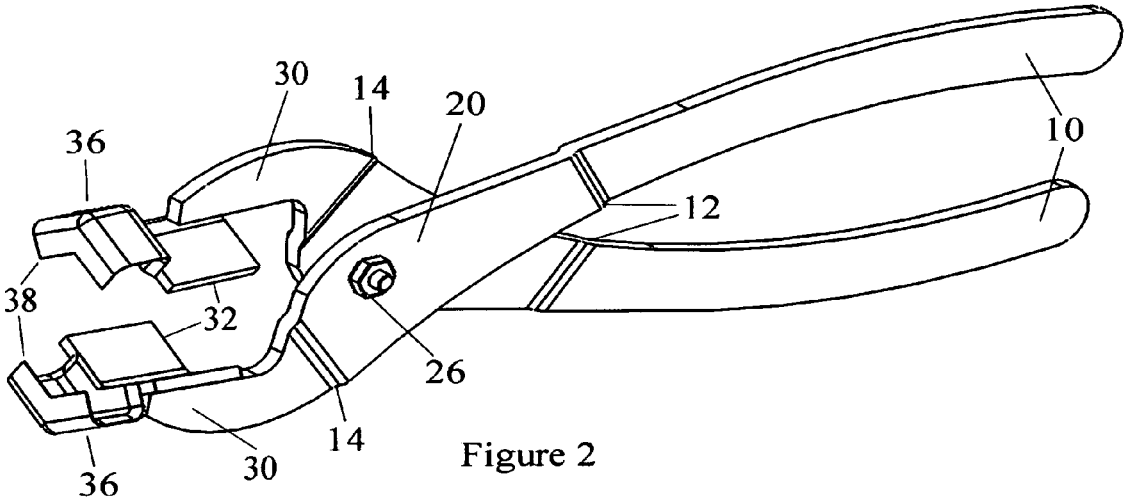

FIG. 2 is the opposite view of FIG. 1 according to the present invention.

Figure 3:
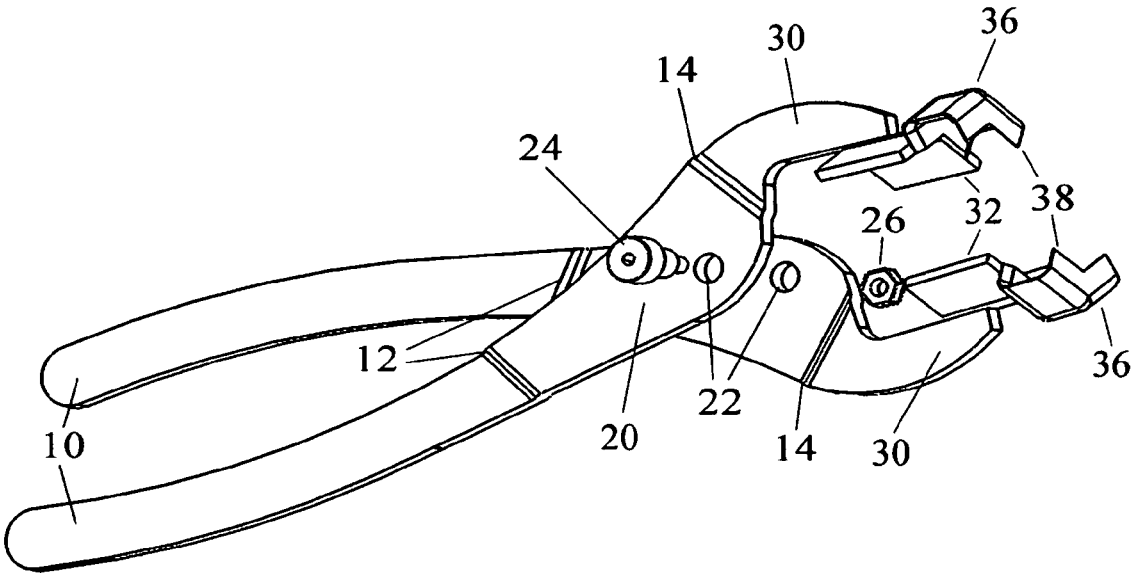

FIG. 3 is an exploded perspective view according to the present invention.

Figure 4:
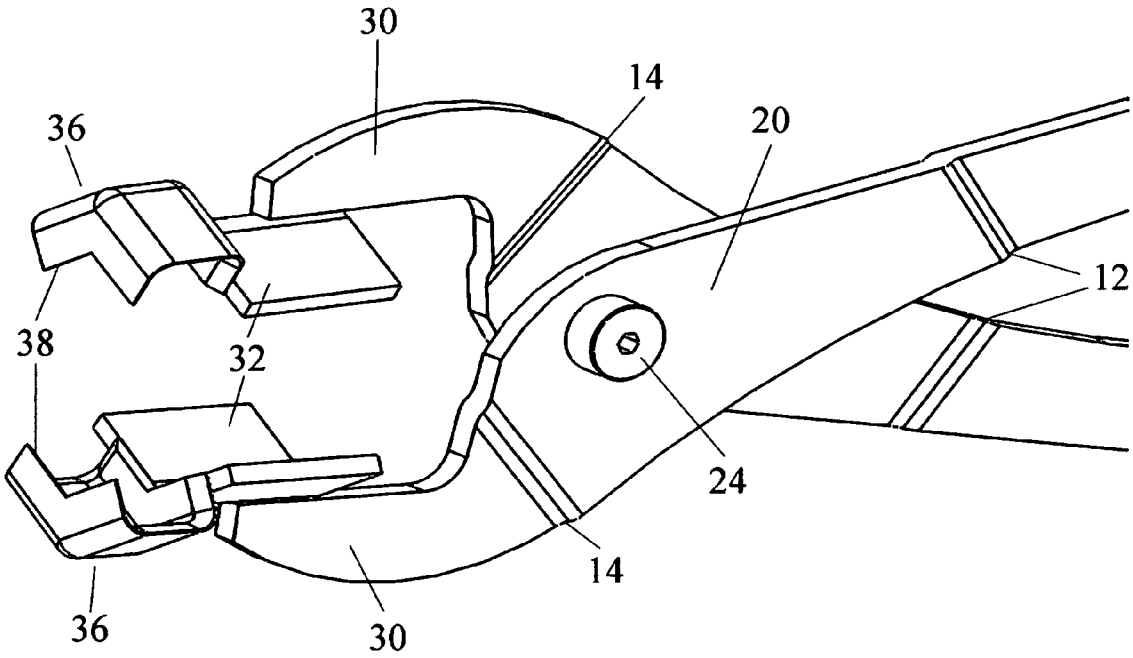

FIG. 4 is a partial perspective view drawn to an enlarged scale illustrating the jaws of the present invention with the jaw portion in a gripping position omitting the lug nut cap.

Figure 5:
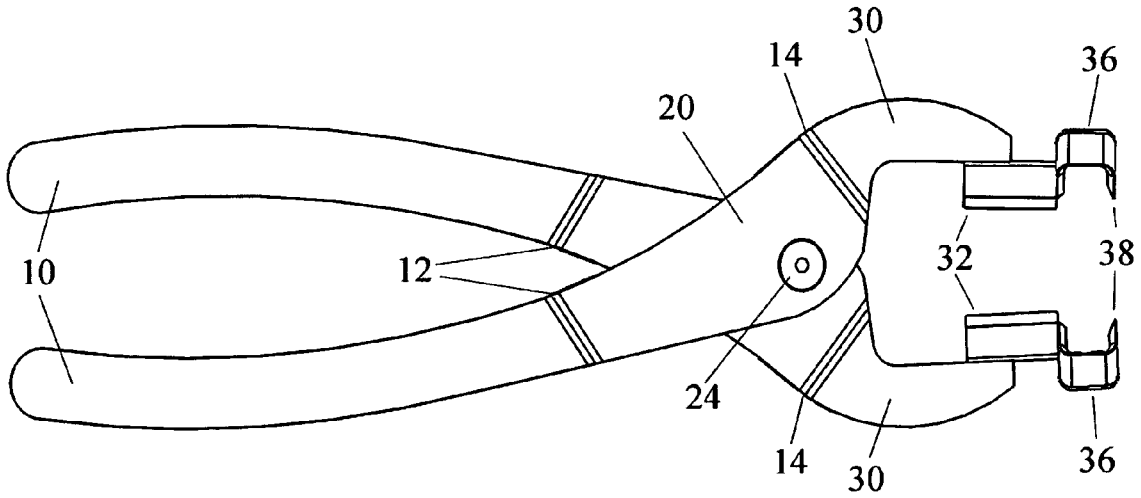

FIG. 5 is a side plan view showing the pliers members with the jaws in a gripping position without a lug nut cap, illustrating the chamfered edge of the jaws.

Figure 6:
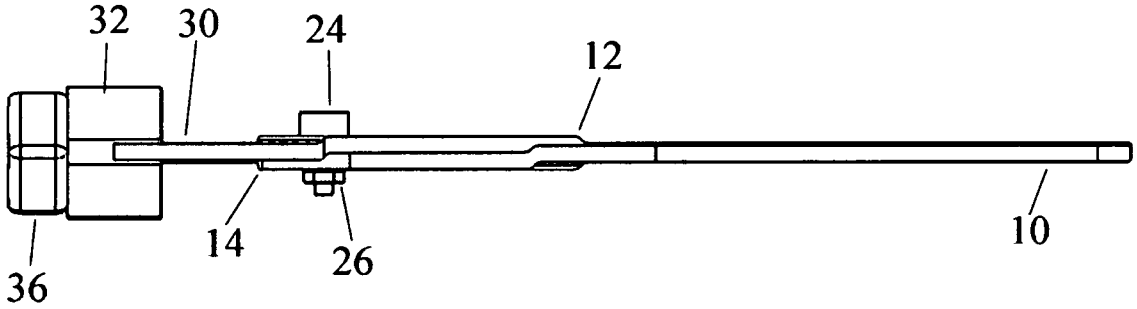

FIG. 6 is a top view according to the present invention.

Figure 7:
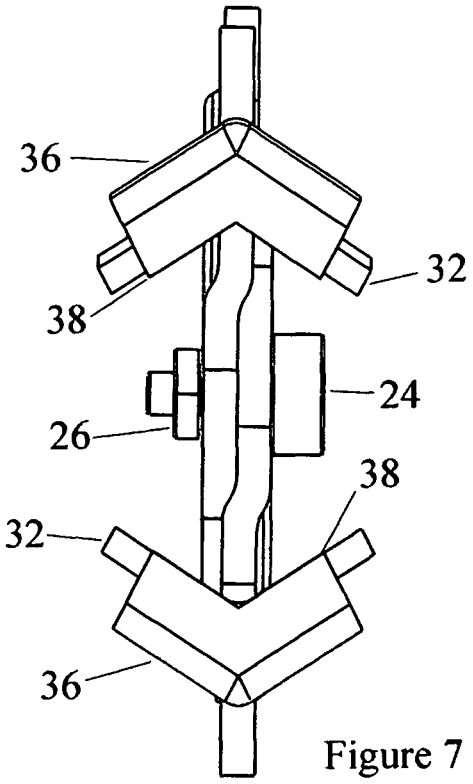

FIG. 7 is a front view of the jaws according to the present invention.

Figure 8:
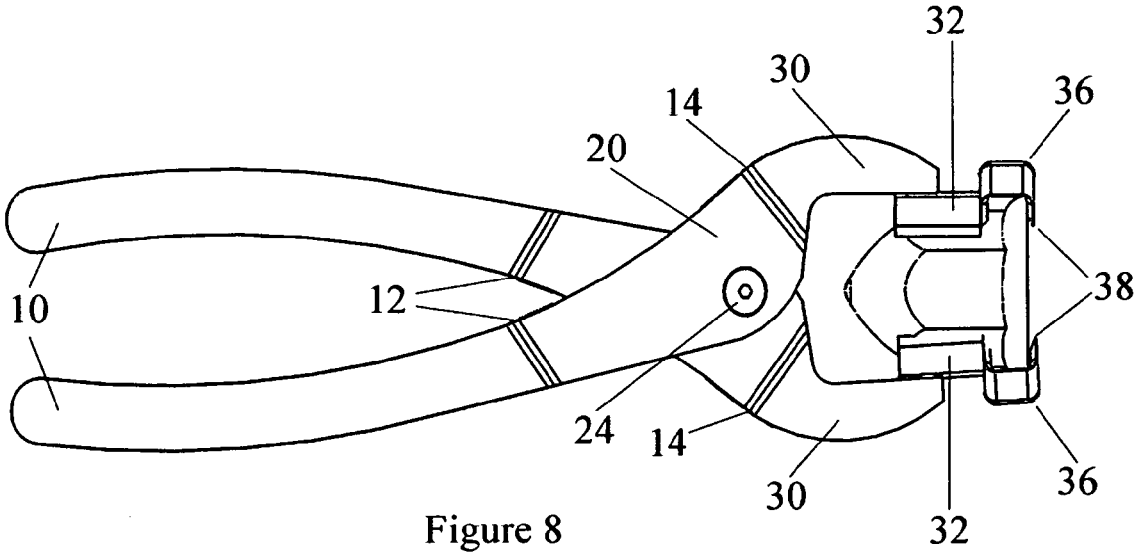

FIG. 8 is a side plan view of the pliers illustrating the jaws gripping a collared lug nut cap according to the present invention.

Figure 9:
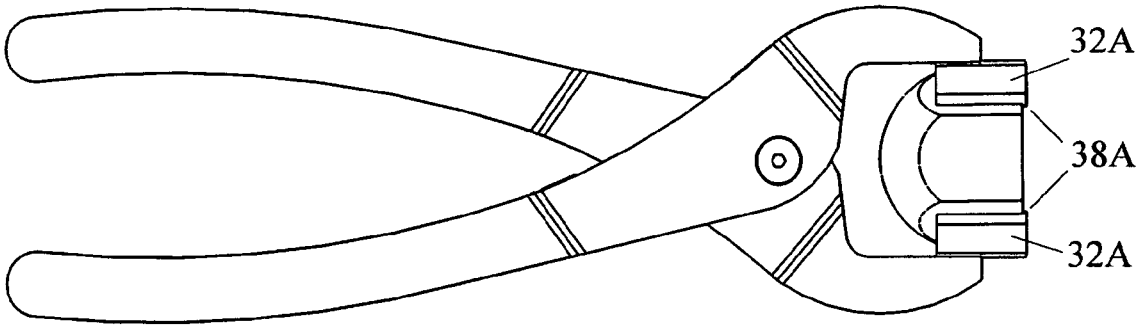

FIG. 9 is a side plan view of an alternative embodiment as FIG. 8 but illustrating the jaws gripping a non-collared lug nut cap according to the present invention.

BEST MODE FOR CARRYING OUT THE INVENTION

Best Mode

The present invention is a pair of pliers designed to facilitate removal of lug nut caps commonly used on commercial trucks. Turning first to FIGS. 1 and 2, a pliers embodying the present invention is comprised of a pair of identical elongated handle designated by the number 10 at one end, a jaw portion 30 at the other end and a neck portion 20 therebetween.

The aperture, shown in FIG. 3 designated by the number 22, in its neck portion 20 adjacent the jaw portion 30, formed therein which is a fixed shoulder bolt designated by the number 24 which extends through and has the shoulder portion of the bolt seated in aperture 22 and held in place by a nut designated by the number 26.

There are offsets in the neck portions 20 designated by the numbers 12 and 14 that allows proper alignment of the jaw portions providing a perfect grip of a lug nut cap.

FIG. 4 illustrates V shaped clamping plates depicted by the number 32, bent at a 120 degree angle that is connected to the jaw portions 30 of the elongated members and attached at the bottom of the V shaped clamping plates. These V shaped clamping plates are designed to grip the sides of the lug nut cap.

FIG. 4 also illustrates the V shaped channels depicted by the number 36 which are attached to the ends of the V shaped clamping plates. These V shaped channels 36 are the clearance allowance for the collar of a collared lug nut cap.

FIG. 5 illustrates the chamfered edges designated by the number 38 which are on the V shaped channels 36. The chamfered edges are what pries between the lug nut cap and the wheel rim, this provides the non-slip secure grip for an easier removal of a lug nut cap than anything presently existing.

Turning now to FIGS. 8 and 9, therein illustrated diagrammatically is the operation of the present invention.

As seen in FIG. 8, the pliers embodying the present invention illustrates the clamping of a collared lug nut cap.

As seen in FIG. 9, the pliers embodying the present invention illustrates an alternative embodiment for the clamping of a non-collared lug nut cap. The jaws are comprised of V shaped clamping plates 32A and chamfered edges 38A which are attached directly to the V shaped clamping plates 32A this allows for the perfect fit and grip of a non-collared lug nut cap.

In practice, it has been found advantageous to mold a synthetic resin grip about both handle portions to provide a comfortable gripping surface.

It is to be understood that the present invention is not limited to the embodiments described above, but encompasses any and all embodiments within the scope of the following claims.

INDUSTRIAL APPLICABILITY

The present invention will not only save the mechanical operator's time but will also resolve safety issues, due to the newly added V shaped channels and the chamfered edges. The chamfered edges at the end of the V shaped channels pry between the lug nut cap and the wheel rim which provides a better grip, without slippage, and as a result saves time because just one usage of the tool can be used to perform the task and will not collapse, scratch or tarnish the beauty of the lug nut caps.

The invention claimed is:

1. A pliers tool for the removal of lug nut caps comprising: a pair of elongated handle portions at one end thereof and a pair of jaw portions at the other end thereof with a pair of neck portions therebetween, said handle portions are oppositely arched and pivotally joined together at the neck portions using a shoulder bolt as a hinge, with a shoulder portion of the shoulder bolt seated in an aperture of both neck portions and held in place by a nut, the pliers further comprising a pair of V-shaped clamping plates, a pair of V-shaped channels, and a pair of V-shaped chamfered edges, a first clamping plate of the pair of V-shaped clamping plates directly attached to a first jaw portion of the pair of jaw portions, a second clamping plate of the pair of V-shaped clamping plates directly attached to a second jaw portion of the pair of jaw portions, a first channel of the pair of V-shaped channels attached to an end of the first clamping plate, a second channel of the pair of V-shaped channels attached to an end of the second clamping plate, a first chamfered edge of the pair of chamfered edges disposed on an end of the first channel, and a second chamfered edge of the pair of chamfered edges disposed on an end of the second channel.

2. The pliers for removing lug nut caps in accordance with claim 1, wherein the pliers consists of offsets in the neck portions that allows proper alignment of the jaw portions.

3. The pliers for removing lug nut caps in accordance with claim 1, wherein an entire surface of the clamping plates is bent at a 120 degree angle forming a V shape.

4. The pliers tool in accordance with claim 1, wherein the handle portions are pivotally joined together for rotation about an axis of rotation, and wherein the first channel defines a first apex extending in a direction orthogonal to the axis of rotation, and the second channel defines a second apex extending in a direction orthogonal to the axis of rotation.

5. The pliers tool in accordance with claim 1, wherein the first and second channels are operable to span a collar of a collared lug nut cap.

6. A pliers tool for the removal of lug nut caps comprising:

a first elongated handle;

a second elongated handle;

a first jaw;

a second jaw;

a first neck extending between the first elongated handle and the first jaw;

a second neck extending between the second elongated handle and the second jaw, said second neck being coupled to said first neck for rotation about an axis of rotation;

a first V-shaped clamping plate coupled to the first jaw;

a second V-shaped clamping plate coupled to the second jaw;

a first V-shaped channel coupled to an end of the first clamping plate, the first V-shaped channel defining a first apex extending in a direction orthogonal to the axis of rotation;

a second V-shaped channel coupled to an end of the second clamping plate, the second V-shaped channel defining a second apex extending in a direction orthogonal to the axis of rotation; and a first chamfered edge disposed on an end of the first V-shaped channel; and a second chamfered edge disposed on an end of the second V-shaped channel.

7. The pliers tool in accordance with claim 6, wherein the first V-shaped clamping plate defines a third apex extending in a direction orthogonal to the axis of rotation and parallel to the first apex, and the second V-shaped clamping plate defines a fourth apex extending in a direction orthogonal to the axis of rotation and parallel to the second apex.

8. The pliers tool in accordance with claim 6, wherein the first and second V-shaped channels are configured to span a collar of a collared lug nut cap.

9. The pliers tool in accordance with claim 6, wherein the first V-shaped clamping plate and the second V-shaped clamping plate each include a surface defining a 120 degree angle for engaging the lug nut cap.

* * * * *